US005810208A

United States Patent [19]

Nixon, II et al.

[11] Patent Number: 5,810,208

[45] Date of Patent: Sep. 22, 1998

[54] ELECTRICALLY POWERED PUMPING SYSTEM

[75] Inventors: William J. Nixon, II, Ormond Beach; Norman Lauterbach, Holly Hill; Warren G. Rasquinha, Daytona Beach, all of Fla.

[73] Assignee: Precision Dispenser, Inc., Ormond Beach, Fla.

[21] Appl. No.: 679,710

[22] Filed: Jul. 12, 1996

[51] Int. Cl.[6] ..... B67D 5/48

[52] U.S. Cl. ..... 222/318; 222/333; 222/385

[58] Field of Search ..... 222/318, 330, 222/331, 333, 380, 385

[56] References Cited

U.S. PATENT DOCUMENTS

| | | | |
|---|---|---|---|
| 2,504,140 | 4/1950 | Mill | 222/385 X |
| 2,623,469 | 12/1952 | Gray | 222/385 X |
| 2,934,245 | 4/1960 | Emeny | 222/333 X |
| 3,055,304 | 9/1962 | Ziegler | 222/385 X |
| 3,151,565 | 10/1964 | Albertson et al. | 222/385 X |
| 3,207,078 | 9/1965 | Cook | 222/333 X |
| 3,806,004 | 4/1974 | Kolkovsky | 222/385 |
| 3,915,351 | 10/1975 | Kiralfy | 222/385 |
| 4,060,182 | 11/1977 | Kikuchi | 222/385 X |
| 5,662,248 | 9/1997 | Collard, Jr. | 222/385 X |

*Primary Examiner*—Kenneth Bomberg

*Attorney, Agent, or Firm*—James H. Beusse; Maguire, Voorhis & Wells

[57] ABSTRACT

An electrically powered pumping system for extracting liquid from a deep container includes an electric motor having a rotor with a drive shaft connected thereto. A centrifugal pump has a driven shaft, and a shaft extension is coupled at one end to the drive shaft of the electric motor and at an opposite end to the driven shaft of the pump. An elongate support member has a first end for receiving the electric motor and a second end for connection to the centrifugal pump. The support member has a central passageway extending from the first and second ends for passage therethrough of the shaft extensions, and a plurality of spaced bearing members are provided in the support member for rotatably supporting the shaft extension therein.

10 Claims, 5 Drawing Sheets

ELECTRICALLY POWERED PUMPING SYSTEM

FIELD OF THE INVENTION

This invention relates in general to pumping systems and in particular to pumping systems which are electrically powered for delivering a liquid from a container therefor to a preselected distant location.

BACKGROUND OF THE INVENTION

In the past, various and sundry pumping systems have been employed for periodically dispensing a liquid from a source thereof to a preselected location remote or distant from the liquid source. In these past pumping systems, it is believed that peristaltic type pumps have been employed to dispense various chemicals as a treatment dose to the aforementioned preselected locations, such as for instance grease traps, drain lines, septic tanks, cesspools, cooling towers and boilers or the like, in order to prevent deleterious clogs, backups or odors therein. Some of the past pumping systems utilized a pump driven by an electric motor, and others of the past pumping systems also employed backup batteries for driving the pump in the event of a power outage. In still others of the past pumping systems, the pumps were run on only batteries where environmental considerations demanded such.

SUMMARY OF THE INVENTION

In general, an electrically powered pumping system in one form of the invention is provided for extracting liquid from a deep container therefor. This pumping system has an electric motor with a rotor and a drive shaft connected thereto, a centrifugal pump with a driven shaft, and a shaft extension coupled between the drive shaft of the electric motor and the driven shaft of the centrifugal pump. An elongate shaft support member has a first end for receiving the electric motor and a second end for connection to the centrifugal pump. The support member has a central passageway extending from the first end to the second end for passage therethrough of the shaft extension, and the support member includes a plurality of spaced bearing means for supporting the shaft extension for rotation within the support member.

Further in general, an electrically powered pumping system is provided in one form of the invention for delivering a treatment chemical to a preselected distant location. In this pumping system, means is provided for containing a supply of the treatment chemical, and means submerged in the treatment chemical in the containing means is operable for pumping the treatment chemical. The pumping means has a set of outlets, and conduit means is connected with one of the outlets for delivering the treatment chemical from the containing means to the preselected distant location upon the operation of the pumping means. Another of the outlets is communicated with the treatment chemical in the containing means so as to circulate and mix the treatment chemical in the containing means upon the operation of the pumping means.

BRIEF DESCRIPTION OF THE DRAWINGS

Corresponding reference characters indicate corresponding parts throughout the several view of the drawings.

The exemplifications set out herein illustrate the preferred embodiment of the invention in one form thereof, and such exemplifications are not to be construed as limiting the scope of the invention or the scope of the disclosure thereof in any manner.

DETAILED DESCRIPTION OF THE PREFERRED EMBODIMENT

Figure 1:
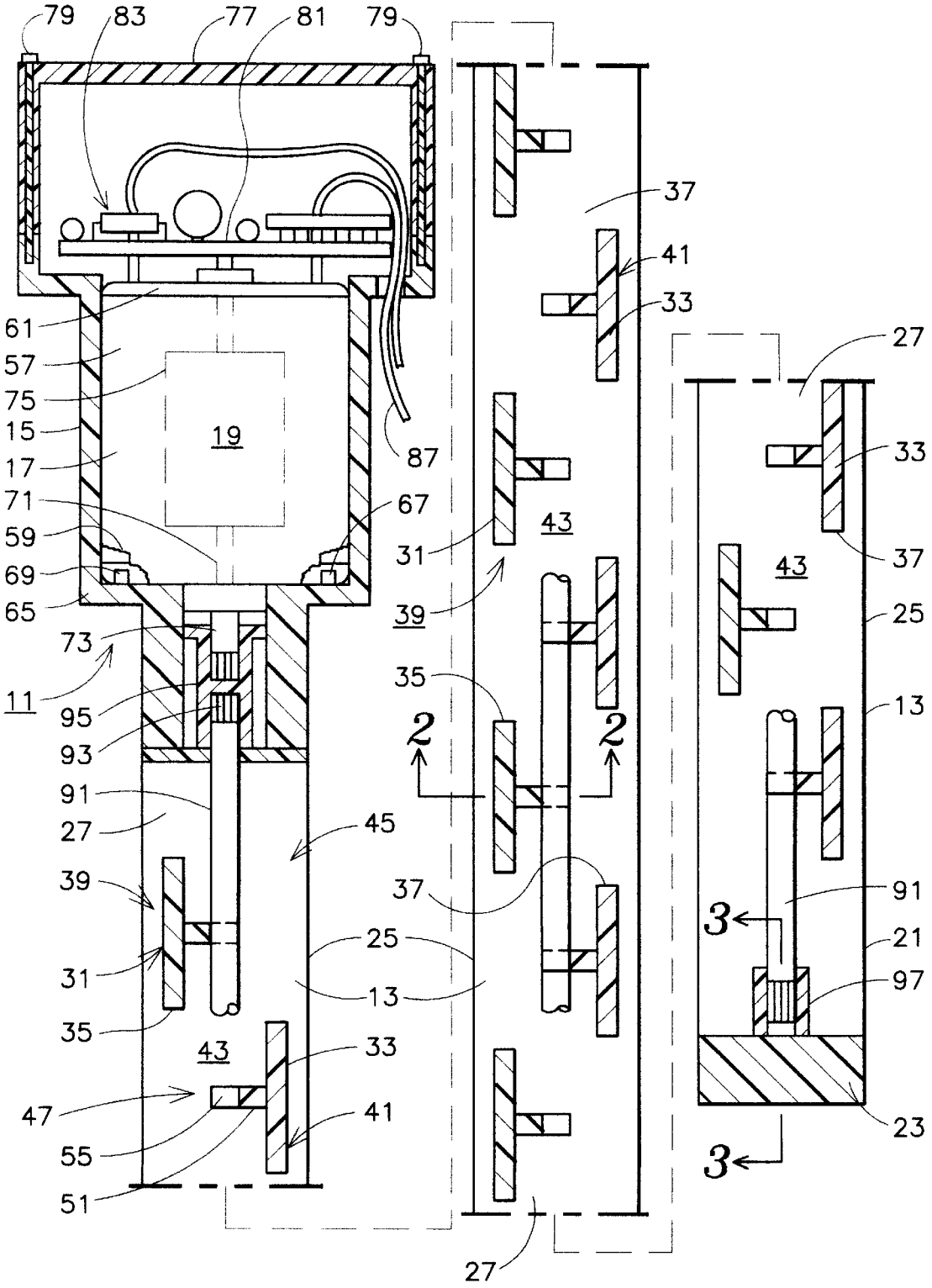
FIG. 1 is a split sectional view illustrating an electrically powered pumping system in one form of the invention partially in cross-section.

Referring now to the drawings in detail, there is shown in FIG. 1 generally at 11 an electrically powered pumping system in one form of the invention. Pumping system 11 is provided with a generally elongate housing or shaft support number 13. Housing 13 is provided with an upper end or end portion 15 which defines a stepped receptacle 17 for receiving an electric motor 19 as discussed in greater detail hereinafter, and a lower end or end portion 21 generally opposite the upper end for supporting or connection with a pump or pumping means 23, as also discussed in greater detail hereinafter. Integrally formed between upper and lower ends 15, 21 of housing 13 is a generally elongate extension or extension means 25, such as for instance an elongate shaft extension member, and it may be noted that the housing is unitary being molded or otherwise formed of a suitable material, such as a resin material or the like for instance.

Figure 2:
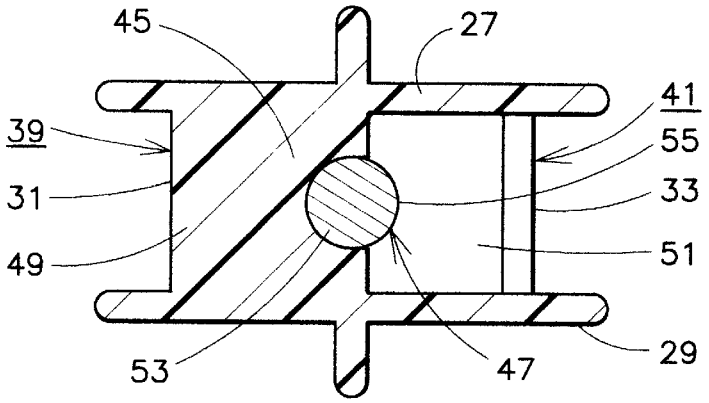
FIG. 2 is an enlarged sectional view taken along line 2—2 in FIG. 1.

Elongate extension 25 of housing 13 is provided with a pair of imperforate spaced apart opposite sides or sidewalls 27, 29 extending between upper and lower ends 15, 21 of the housing and as also shown in FIG. 2, a pair of sets of spaced or spaced apart segments 31, 33 are integrally formed between opposite sides 27, 29 of the elongate extension. It may be noted that spaced apart segments 31, 33 are predeterminately arranged in non-overlapping relation or order with respect to each other, and a pair of sets of openings 35, 37 are provided between segments 29, 31 in each of the segment sets, respectively. It may be further noted that at least some of openings 35 are predeterminately arranged in overlapping relation with adjacent ones of openings 37 and that at least some of openings 37 are predeterminately arranged in overlapping relation with adjacent ones of openings 35. It is believed that the above discussed spacing or arrangements of segments 31, 33 and openings 35, 37 is advantageous in order to effect the aforementioned unitary molding of housing 13.

In view of the foregoing, it may be seen that segments 31 and openings 35 at least in part define a perforate sidewall 39 integrally interconnected between opposite sidewalls 27, 29 and that segments 33 and openings 37 at least in part defines another perforate sidewall 41 extending generally in opposite spaced apart relation with sidewall 39 and also integrally interconnected between opposite sidewalls 27, 29. Of course, a generally central passage or passageway 43 is defined in part between opposite sidewalls 27, 29 and 39, 41 of elongate extension 25, and the passageway extends between upper and lower ends 15, 21 of housing 13. To complete the description of elongate extension 25 on housing 13, it may be noted that segments 31, 33 of the segment sets include a pair of sets of bearings or bearing means 45, 47, such as for instance a pair of sets of plate-like elements or protrusions 49, 51 extending generally in opposite relation from at least some of the segments into central passageway 43 with the protrusions defining a pair of sets of half bearing surfaces 53, 55 on the free end thereof, respectively, as also seen in FIG. 2.

As previously mentioned, electric motor 19 is received or otherwise supported in stepped receptacle 17 at upper end 15 of housing 13, and it is contemplated that the electric motor may be of the fractional horsepower direct current type well known to the art. Electric motor 19 is provided with a generally annular casing 57 interposed between a pair of opposite end frames 59, 61, and the annular casing is received or otherwise supported in abutment with an annular wall 63 of receptacle 17 while lower end frame 59 is seated against a generally annular shoulder 65 on the receptacle which intersects with the annular wall thereof. A plurality of locating pins or stops 67 integral with annular shoulder 65 extend therefrom through a plurality of cooperating apertures 69 in lower end frame 59 into locating or positioning abutment therewith, and such abutments between the stops and the apertures serve to obviate or at least limit rotational movement within receptacle 17 of electric motor 19.

A generally coaxial motor or drive shaft 71 shown in part in dotted outline, is suitably rotatably journaled in opposite end frames 59, 61 of electric motor 19, as well known in the art, and an end or end portion 73 of the drive shaft extends exteriorly of the electric motor through lower end frame 59 thereof into central passageway 43 of housing 13. As also shown in dotted outline, a rotor 75 is carried on drive shaft 71 within casing 57 of electric motor 19, and upon the energization of the electric motor, the rotor is rotatably driven to effect the conjoint rotation therewith of the drive shaft. A closure member, such as a generally annular end cap 77 or the like for instance, is received in abutment with annular wall 63 of receptacle 17 so as to enclose electric motor 19 therein, and the annular end cap is retained against displacement from the receptacle for suitable retaining a fastening means, such as for instance a set of screws 79 or the like.

End cap 77 also encloses a printed circuit board 81 for electric motor 19 within housing 13. Printed circuit board 81 having a plurality of electric components 83 connected in circuit relation thereon is supported or mounted in circuit relation on a pair of electric motor terminals 85, 87, and the terminals extend through upper end frame 61 of electric motor 19. A pair of electric motor leads 87 are also respectively connected in circuit relation with printed circuit board 81 and electric components 83 thereof, and the leads extend exteriorly of receptacle 17 through end cap 77 for connection to a power source (not shown) in order to effect the energization of electric motor 19, as discussed hereinafter. Electronic components 83 are arranged in circuit relation on printed circuit board 81 to provide an electronic timer for controlling or otherwise sequencing or timing the energization of electric motor 19; however, since the actual printed circuit of printed circuit board 81 and the connection of electronic components 83 therewith are not a part of this invention, further description thereof are omitted for the purpose of brevity of disclosure and drawing simplification.

Figure 3:
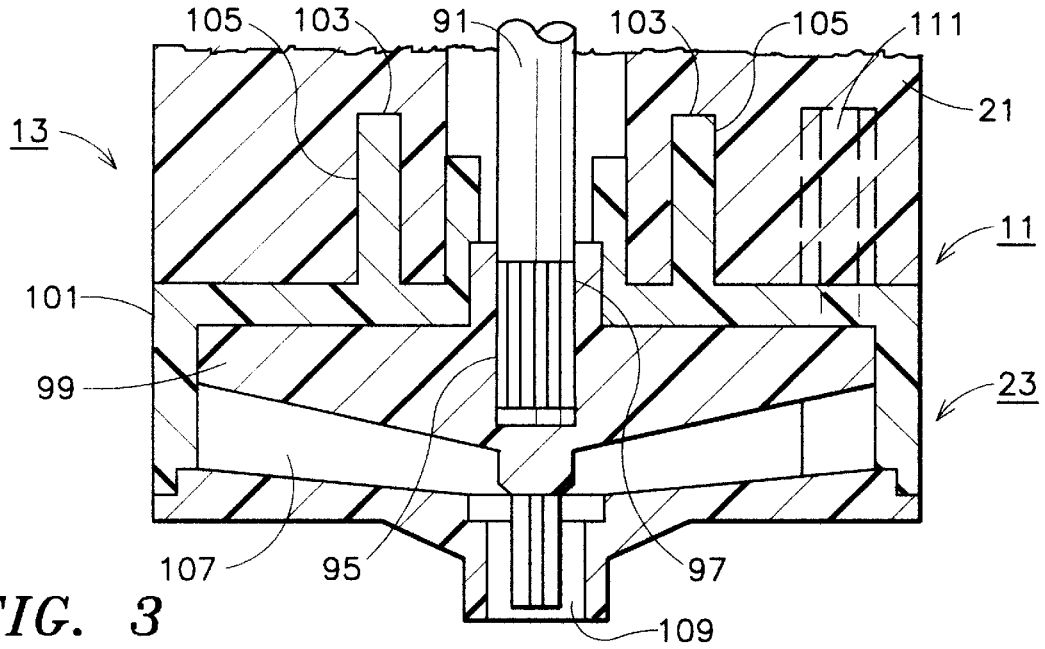
FIG. 3 is an enlarged sectional view taken along line 3—3 in FIG. 1.

Pumping system 11 is provided with an intermediate shaft or shaft extension 91 extending generally axially through central passageway 43 in housing 13, and it may be noted that the shaft extension is rotatably journaled on half bearing surface 53, 55 provided on protrusions 49, 51 extending from segments 31, 33 into passageway 43, as previously mentioned and as also seen in FIG. 2. Shaft extension 91 has an upper end or end portion 93 interconnected for conjoint rotation with free end 73 on drive shaft 71 of electric motor 19 by suitable interconnecting means, such as for instance a coupler 95 or the like. If desired, coupler 95 may be formed of any suitable resin material, and may be arranged in pressed-on or press-fit engagement with upper end portion 93 of shaft extension 91 and free end 73 of electric motor drive shaft 71. A lower end portion 95 of shaft extension 91 is received in pressed-on or press-fit engagement within a driven shaft 97 of an impeller 99 in centrifugal pump 23 so that the impeller is conjointly rotatable with the shaft extension, as seen in FIG. 3.

Centrifugal pump 23 is provided with a casing 101, having a set of predeterminately arranged guide or locating pins 103 extending therefrom into locating or positioning engagement within a cooperating set of locating recesses 105 predeterminately arranged in lower end portion 21 of housing 13 in order to predeterminately effect accurate positioning or location of the centrifugal pump on the housing, and albeit not shown for purpose of drawing simplification, adjacent surfaces on casing 101 of centrifugal pump 23, lower end portion 21 of housing 13 may be secured together or connected against displacement by suitable means, such as for instance sonic welding or the like.

Impeller 99 and casing 101 of centrifugal pump 23 may be formed of any suitable material, such as for instance a resin material or the like, and if desired the centrifugal pump and housing 13 may be formed of the same material. As previously mentioned, lower end 95 of shaft extension 91 is received in press-fitted engagement within driven shaft 97 of impeller 99, and the driven shaft is rotatably received or otherwise journaled in casing 101 of centrifugal pump 23. To complete the description of electrically powered pumping system 11, impeller 99 is rotatably arranged in a pumping chamber 107 within casing 101 so as to pump a liquid (not shown) from an inlet or inlet port 109 in the casing communicated with the pumping chamber, through the pumping chamber, and therefrom to an outlet or outlet port 111 in the casing also communicated with the pumping chamber.

Figure 4:
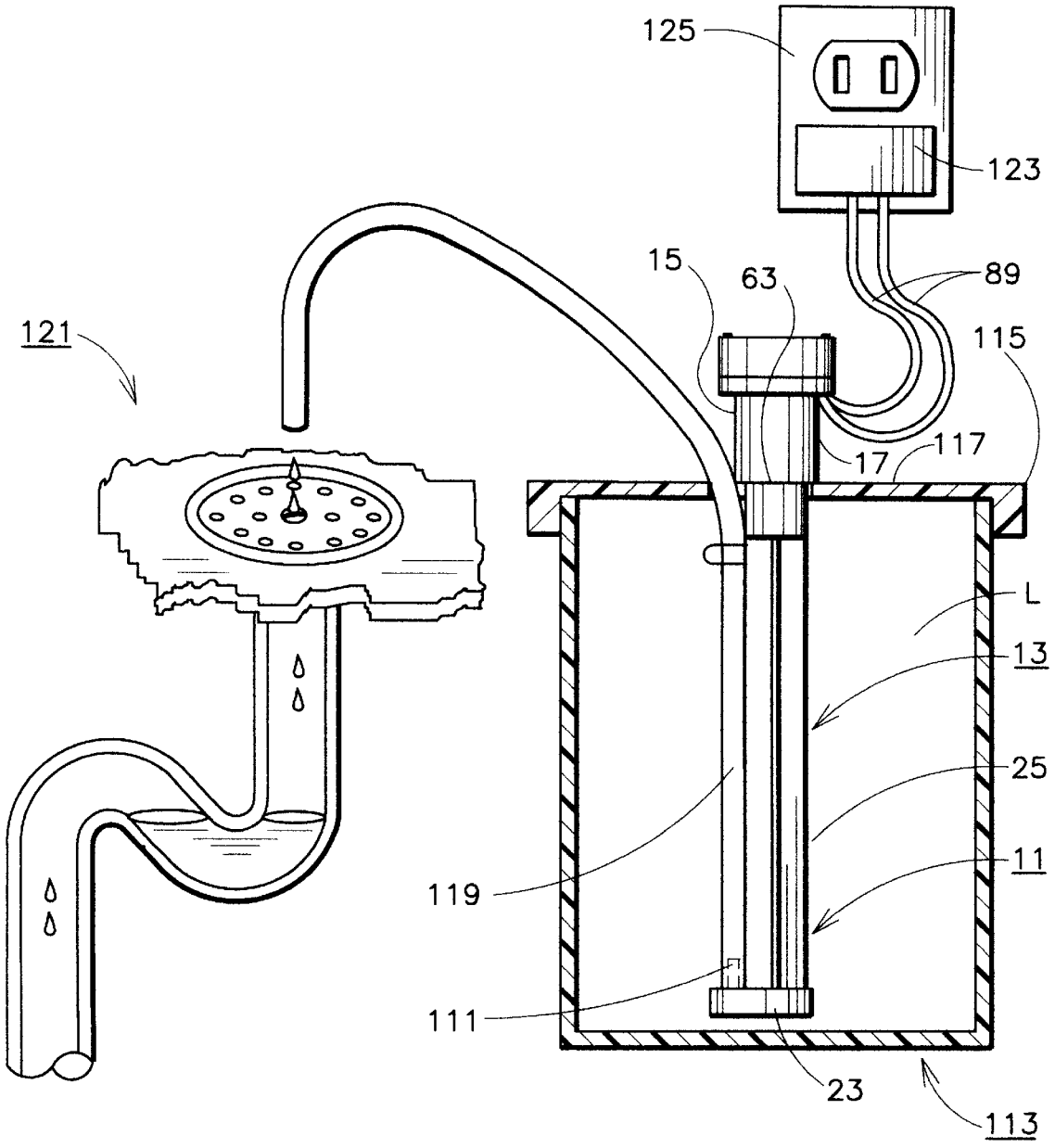
FIG. 4 is a diagrammatic view illustrating the use of the electrically powered pumping system of FIG. 1 to deliver a dose of a treatment chemical to a distant location.

In the operation of electrically powered pumping system 11, a supply of a liquid L, such as for instance a treatment chemical or a mixture of treatment chemicals or the like, is provided in a deep container or containing means 113, such as for instance a barrel or bucket or the like, and a closure member or lid 115 having a generally central aperture 117 therethrough is received atop container 113 in enclosing relation therewith as seen in FIG. 4. Annular shoulder 63 of receptacle 17 adjacent upper end 15 of housing 13 is seated on lid 115 extending generally about aperture 117 therein, and centrifugal pump 23 and at least a part of elongate extension 25 of housing 13 extend into container 113 so as to be submerged in liquid L therein.

A tube, conduit or conduit means 119 formed of any suitable material, such as for instance a resin material or the like, extends through aperture 117 in lid 115, and one end of the conduit is communicated with outlet port 111 of centrifugal pump 23 while the other end of the conduit may be disposed adjacent a preselected distant location, indicated generally at 121, remote from container 113. Of course, preselected distant location 121 may be any device which may be in need of treatment liquid L dispensed thereto, and although the preselected distant location is illustrated herein as a drain having a goose neck for purpose of disclosure, it is contemplated that such preselected distant location may define various other devices or apparatus well known to the art, as discussed hereinbefore, and to which treatment liquid L may be dispensed.

Motor leads 89 of electric motor 19 in housing 13 of electrically powered pumping system 11 are connected through a plug device 123 of a type well known to the art, to an AC power source which may be of any preselected voltage, as illustrated by an electrical outlet 125 or the like for instance as well known to the art, of course, plug device 123 includes a rectifier (not shown) for converting the A.C. power to D.C. and a step-down transformer (not shown) for reducing the power source voltage to a preselected low voltage value, such as for instance 12 volts or the like. Thus, a preselected low voltage D.C. power is delivered through motor leads 89, printed circuit board 89 and electronic components 91 thereof to terminals 85, 87 of electric motor 19 to effect its energization, as shown in FIG. 1.

With reference to FIGS. 1, 3 and 4, drive shaft 71 and rotor 75 thereof are rotated to conjointly rotatably drive shaft extension 91 and impeller 99 in centrifugal pump 23 upon the energization of electric motor 19. Of course, the driven rotation of impeller 99 in chamber 107 of centrifugal pump casing 101 effects this flow of treatment liquid L from container 113 through inlet port 109, pumping chamber 107 and outlet port 111 of the centrifugal pump into conduit 119 and therefrom to distant location 121. As previously mentioned, electronic components 83 on printed circuit board are operable to effect the energization of electric motor 19 at preselected times or periods to dispense treatment liquid L in the manner discussed hereinabove to preselected distant location 121 with the dispensed treatment chemical serving as a treatment dosage in order to prevent clogs, backups, odors or other deleterious problems which may occur at such preselected distant location.

Figure 5:
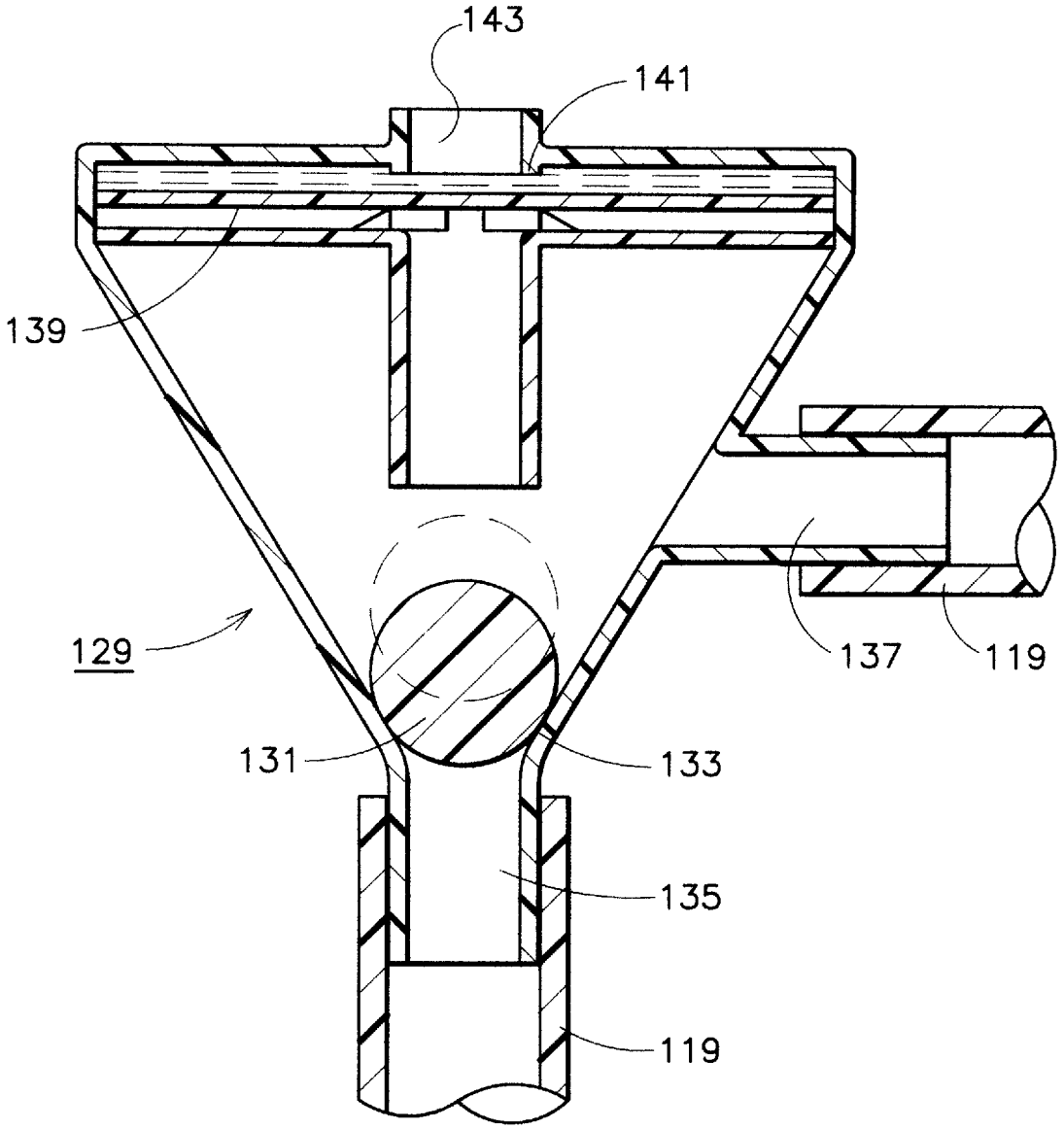
FIG. 5 is a sectional view illustrating a valve device in cross-section which may be employed in one form of the invention with the electrically powered pumping system of FIG. 1.

Referring now to FIG. 5, a valve device 129 is shown interposed in conduit 119 of FIG. 4 exteriorly of container 113 between centrifugal pump 23 and distant location 121, and the valve device is operable generally for at least limiting siphoning flow of treatment liquid L from the container to the distant location in the event that the elevation of the distant or free end of the conduit at the distant location is lower than the elevation of the container, as discussed in greater detail hereinafter.

Albeit not shown in FIG. 4, assume for the purpose of discussion that the elevation of the distal end of conduit 119 is lower than the elevation of container 113. As previously discussed, centrifugal pump 23 is operable in response to the energization of electric motor 19 of pumping system 11 to deliver treatment liquid L from container 113 through conduit 119 to distant location 121. The fluid pressure of treatment liquid L delivered by centrifugal pump 23 acts on the effective area of a metallic ball-type check valve 131 displacing it from its sealed or closed position in engagement with its seat 133 toward an open position as shown in dotted outline displaced from seat 133 in order to permit the flow of treatment liquid L through valve device 129 from its inlet or inlet port 135 to its outlet or outlet port 137.

At least generally simultaneously with the above discussed displacement of check valve 131 from its seat 133, the fluid pressure of liquid L delivered by centrifugal pump 23 also acts on the effective area of a disc valve 139 to displace the disc valve from its normally open position toward a closed position in engagement with its seat 141 about an atmospheric port 143 of valve device 129, as shown in dotted outline in FIG. 4. Thus, upon the seating engagement of disc valve 139 with its seat 141, atmospheric port 143 of valve device 129 is closed thereby to interrupt communication between outlet and atmospheric ports 119, 143 through the valve device. With atmospheric port 143 closed by the above discussed seating engagement of disc valve 139 with its seat 141, centrifugal pump 23 is operable to continue the delivery of treatment liquid L from container 113 through conduit 119 and valve device 129 to distant location 121. Disc valve 133 may be formed of any suitable material, such as a paper-thin disc of a resin material or the like for instance.

Upon the de-energization of electric motor 19 of pumping system 11, centrifugal pump 23 is deactuated to interrupt the delivery of treatment liquid L from container 113 through conduit 119 and valve device 129 to distant location 121. Since it was previously assumed that the elevation of the distal end of conduit 119 at distant location 121 was lower or less than the elevation of container 113, it may be noted that a siphoning flow of treatment liquid L is generally momentarily established from container 113 through centrifugal pump 23, conduit 119 and valve device 129 to distant location 121 in the place of the above discussed flow of treatment liquid L delivered by the centrifugal pump during its operation. Of course, it is mandatory that the siphoning flow of treatment liquid L be interrupted or dis-established in order to prevent the deleterious siphoning from container 113 of the entire content of liquid L therein.

The momentary establishment of the siphoning flow of treatment liquid L is, of course, accompanied by a fluid pressure drop across inlet and outlet ports 135, 137 of valve device 129 which, of course, creates a negative fluid pressure within the valve device. The opposed effective areas of disc valve 139 are respectively subjected to the aforementioned negative fluid pressure and the atmospheric pressure at atmospheric port 143 of valve device 129 thereby to create a force acting on the disc valve to disengage the disc valve from its seat 141 and move the disc valve to its open position in valve device 129. When disc valve 139 is so moved to its open position, as described above, the atmospheric fluid pressure at atmospheric port 143 is effective to interrupt the engagement of a circumferential edge or edge portion 145 of the disc valve with the valve device in order to subject outlet and inlet ports 135, 137 of the valve device to the atmospheric fluid pressure of atmospheric port 143. In response to the above discussed communication of inlet and outlet ports 135, 137 with atmospheric port 143 of valve device 129, the previously mentioned negative fluid pressure at the inlet and outlet ports is eliminated which, of course, also eliminates the aforementioned siphoning flow of treatment liquid L. Upon the elimination of the siphoning flow of treatment liquid L through valve device 129, check valve 131 will be moved by the force of gravity from its open position to reseat in sealing engagement with its valve seat 133 in the valve device.

Figure 6:
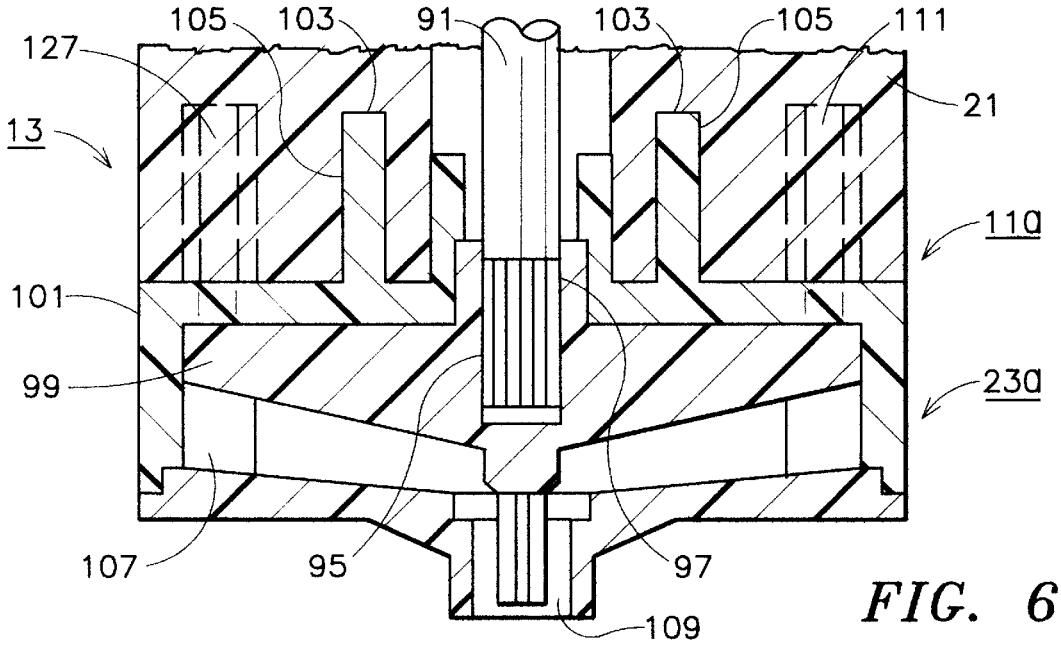
FIG. 6 is a sectional view illustrating an alternative centrifugal pump in cross-section as utilized in an alternative electrically powered pumping system also in one form of the invention.

As seen in FIG. 6, an alternative electrically powered pumping system 11*a* in one form of the invention is shown in part, and alternative electrically powered pumping system 11*a* has the same component parts operable in the same manner as those of the previously described electrically powered pumping system 11 with the exceptions noted below.

Figure 7:
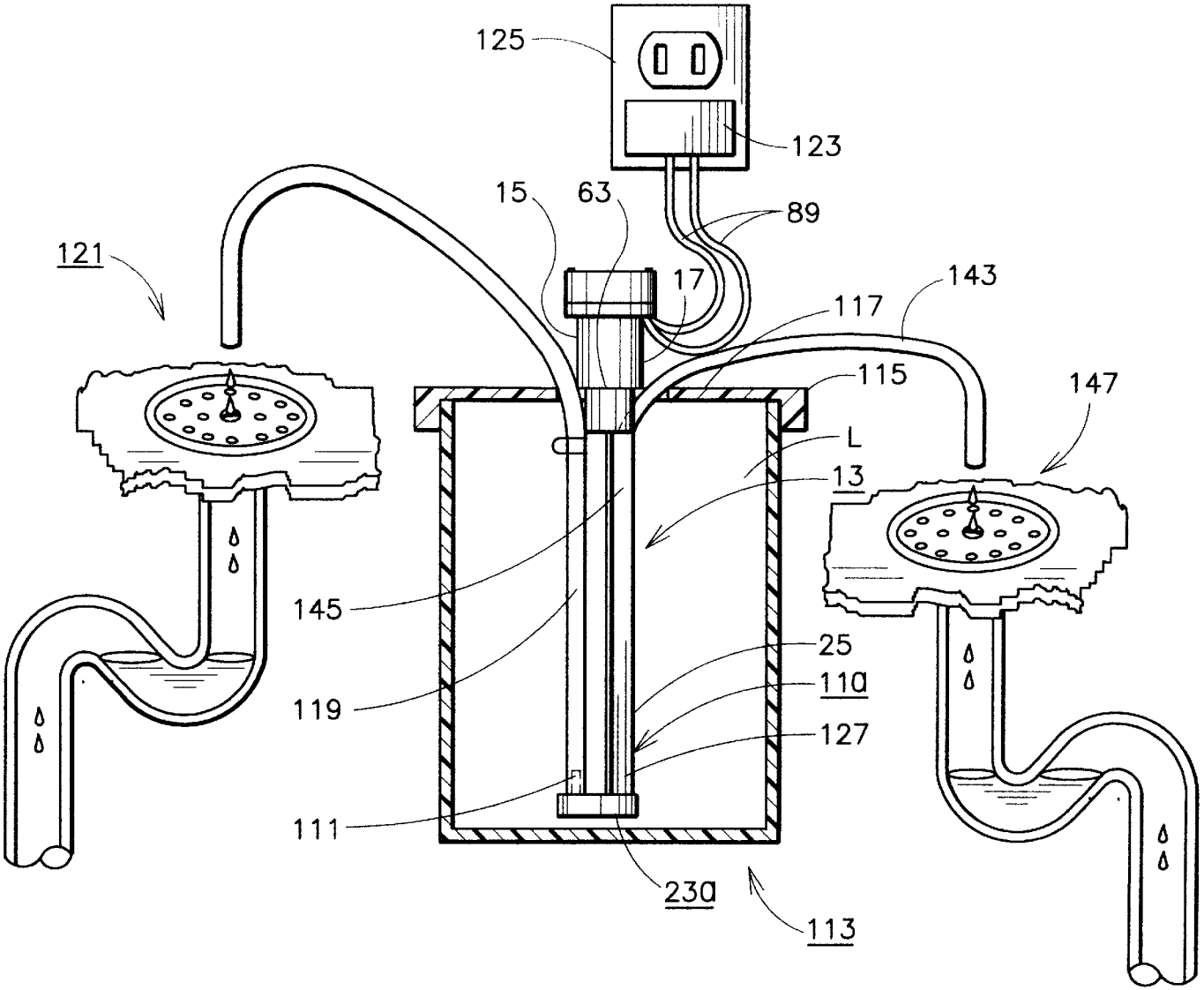
FIG. 7 is a diagrammatic view illustrating the use of the alternative electrically powered pumping system of FIG. 6 to simultaneously deliver separate doses of the treatment chemical to separate distant locations.

In electrically powered pumping system 11*a,* another centrifugal pump 23*a* is connected to lower end 21 of housing 13, and it may be noted that casing 101 of centrifugal pump 23*a* is provided with an additional outlet port 127 which is generally diametrically arranged with outlet port 111. As seen in FIG. 7, when electrically powered pumping system 11*a* is associated with container 113 in the same manner as discussed hereinabove with respect to electrically powered pumping system 11, another tube, conduit or conduit means 145 formed of a suitable material, such as for instance a resin material or the like, extends through aperture 117 in lid 115 of container 113, and one end of the conduit is communicated with outlet port 127 of centrifugal pump 23*a* while the other end of the conduit is disposed adjacent another distant location, indicated generally at 147, which, if desired, may be of the same general types as those discussed hereinbefore with respect to distant location 121.

In the operation of electrically powered pumping system 11*a,* impeller 99 of centrifugal pump 23*a* is rotatably driven upon the energization of electric motor 19 to not only effect the flow of treatment liquid L from container 113 through conduit 119 connected with outlet port 111, as previously discussed, but also effects a simultaneous flow of treatment liquid L from container 113 through inlet port 109, pumping chamber 107, additional outlet port 127 and conduit 145 connected therewith to additional distant location 147. Thus, electrically powered pumping system 11*a* may be utilized in one form of the invention to simultaneously deliver separate flow of treatment liquid L from container 113 to distant locations 121, 147.

Albeit not shown for purposes of drawing simplification, conduit 145 may, if desired, be disconnected from outlet port 127 of centrifugal pump 23*a* and removed from association with electrically powered pumping system 11*a,* container 113 and distant location 147 in one form of the invention. When conduit 145 is disassociated from electrically powered pumping system 11*a,* container 113 and distant location 147, as mentioned above, it may be noted that additional outlet port 127 of centrifugal pump 23*a* is submerged in or directly communicated with treatment liquid L in container 113. Thus, upon the energization of electric motor 19 of electrically powered pumping system 11*a,* centrifugal pump 23*a* is operable not only to effect the flow of treatment liquid L to distant location 121 from container 113 through conduit 119 connected with outlet port 111 of centrifugal pump 23*a,* but also effects another or return flow of treatment liquid L from container 113 through inlet port 109, pumping chamber 107 and additional outlet port 127 back into the container. It is believed that some treatment chemicals may have the tendency to separate out in container 113; therefore, it is believed that treatment liquid L discharged from additional outlet port 127 of centrifugal pump 23*a* is effective to advantageously circulate and mix the treatment liquid L in container 113 in order to either prevent the separation of the treatment chemicals or effect the re-mixture of such treatment chemicals in the event of the separation thereof in container 113.

From the foregoing, it is now apparent that novel electrically powered pumping systems 11, 11*a* have been presented and that modification or changes as to the precise configuration and details of the components of such electrically powered pumping systems may be made by those having ordinary skill in the art without departing from the spirit of the invention or the scope thereof, as defined by the claims which follow.

What is claimed is:

1. An electrically powered pumping system for extracting liquid from a deep container, the system comprising:

an electric motor including a rotor, and a drive shaft connected to said rotor;

a centrifugal pump including a driven shaft;

a shaft extension coupled at one end to said drive shaft of said electric motor and at an opposite end to said driven shaft of said centrifugal pump, each of said one end and said opposite end being supported for rotation by shaft extension end support bearing members positioned adjacent thereto; and an elongate shaft support member having a first end for receiving said electric motor and a second end for connection to said centrifugal pump, said shaft support member having a central passageway extending from said first end to said second end for passage therethrough of said shaft extension, and said shaft support member further including a plurality of integrally formed, spaced bearing means disposed along said shaft support member between said end support bearing members for supporting said shaft extension throughout said shaft support member.

2. The pumping system of claim 1 wherein said shaft support member comprises a unitary, molded plastic member and said central passageway is defined by spaced segments arranged in non-overlapping order on opposite sides of said passageway.

3. The pumping system of claim 2 and including a plurality of plate-like elements extending from said segments toward said passageway, each of said elements having a free end within said passageway and said free ends at least in part comprising said bearing means, respectively.

4. The pumping system of claim 3 wherein said shaft support member includes an integrally formed receptacle at said first end for receiving said electric motor.

5. The pumping system of claim 4 further comprising means for securing together said shaft support member and said centrifugal pump.

6. The pumping system of claim 1 wherein said centrifugal pump includes a pair of circumferentially spaced outlets, one of said outlets having a tube connected thereto for delivery of the liquid from said centrifugal pump to a distant location, another of said outlets opening into the container whereby the liquid in the container is circulated and mixed by operation of said centrifugal pump.

7. The pumping system of claim 1 and including an electronic timer for controlling the energization of said electric motor.

8. The pumping system as set forth in claim 1 wherein said centrifugal pump includes a pair of spaced apart outlets, and a pair of conduit means connected with said outlets for delivery of the liquid from said centrifugal pump to a separate pair of distant locations, respectively.

9. The pumping system as set forth in claim 1 wherein said centrifugal pump includes an outlet, and conduit means connected with said outlet for delivery of the liquid from said centrifugal pump to a distant location upon the energization of said electric motor.

10. The pumping system as set forth in claim 9 further comprising a valve device connected in said conduit means between said centrifugal pump and the distant location and operable generally for at least limiting siphoning flow of the liquid from the container to the distant location upon the deenergization of said electric motor.

* * * * *